United States Patent [19]

Kagerhuber et al.

[11] 4,237,760

[45] Dec. 9, 1980

[54] SHEARING MACHINE TO BE USED IN BOW-TYPE CONTINUOUS CASTING PLANTS

[75] Inventors: Franz Kagerhuber, Traun; Wolfgang Lederer, Haid, both of Austria

[73] Assignee: Voest-Alpine Aktiengesellschaft, Linz, Austria

[21] Appl. No.: 957,549

[22] Filed: Nov. 3, 1978

[30] Foreign Application Priority Data

Nov. 22, 1977 [AT] Austria ..... 8337/77

[51] Int. Cl.[3] ..... B26D 5/02; B22D 11/126

[52] U.S. Cl. ..... 83/529; 83/304; 83/563; 164/263

[58] Field of Search ..... 164/263, 270, 417, 269; 83/563, 304, 305, 320, 525, 529, 630; 425/451.5, 451.6, 592, 593, DIG. 220, DIG. 222; 100/257

[56] References Cited

U.S. PATENT DOCUMENTS

| | | | |
|---|---|---|---|
| 1,327,710 | 1/1920 | Hemstreet | 425/DIG. 220 |
| 2,757,731 | 8/1956 | Musly | 83/623 X |
| 3,253,492 | 5/1966 | Petros et al. | 83/563 X |
| 3,292,475 | 12/1966 | Ross | 83/563 X |

FOREIGN PATENT DOCUMENTS

| | | |
|---|---|---|
| 248837 | 8/1966 | Austria . |
| 95489 | 12/1897 | Fed. Rep. of Germany . |

*Primary Examiner*—Robert D. Baldwin
*Assistant Examiner*—J. Reed Batten, Jr.
*Attorney, Agent, or Firm*—Brumbaugh, Graves, Donohue & Raymond

[57] ABSTRACT

In a shearing machine to be used in bow-type continuous casting plants for separating continuously cast strands, such as slabs or billets, two cutters are arranged in a carrying construction. One lower cutter of the machine is movable towards and away from an upper cutter fixed in the carrying construction during the cutting procedure. The upper cutter can be shifted by means of a toggle linkage adjustment device, out of a working position immediately above the surface of the pieces to be cut, into a pulled-back position farther removed from the surface of the pieces to be cut, and vice versa.

3 Claims, 3 Drawing Figures

SHEARING MACHINE TO BE USED IN BOW-TYPE CONTINUOUS CASTING PLANTS

BACKGROUND OF THE INVENTION

The present invention relates to a shearing machine for bow-type continuous casting plants, for separating continuously cast strands, such as slabs or billets, which shearing machine comprises two cutters arranged in a carrying construction, a lower one of the cutters being movable towards and away from an upper cutter that is fixed in the carrying construction during the cutting procedure.

Shearing machines of this type, in bow-type continuous casting plants, are arranged on the run-out roller table following the straightening zone, and serve for separating the crop-ends of a cast strand and for dividing the cast strand into sections of predetermined lengths. Because of the fact that the lower cutter is moved towards the resting upper cutter during the cutting procedure, these shearing machines have the advantage that the rollers of the run-out roller table need not be lowered during the cutting procedure.

The totally solidified strand always leaves the straightening aggregate with its end curved up by an amount depending on the distance between the rollers arranged at the end of the straightening aggregate in the casting direction and due to a certain resilience of the strand end. As a result the position of the upper cutter in known shearing machines of the defined kind always has to be chosen in accordance with the height of the upward curvature of the strand end of the thickest strand castable in the plant. This is done in order to enable the curved-up end of the strand to pass between the upper and the lower cutters for the conveying out of the same. For this reason, a great distance will always be present between the cutting edge of the upper cutter and the upper surface of the strand. Consequently it is necessary before the cutting procedure as such, to lift the strand by means of the lower cutter until it touches the cutting edge of the upper cutter. This lifting performance has to be carried out, in addition to the cutting performance, by the devices moving the lower cutter, which proves to be detrimental in that the dimensioning of these means and the energy consumption of the shearing machine must be larger than would otherwise be necessary.

SUMMARY OF THE INVENTION

The invention aims at avoiding these disadvantages and difficulties and has as its objects to provide a shearing machine wherein the cutting edge of an upper cutter can be adjusted as close as possible to the strand surface, so that means moving a lower cutter have to carry out hardly any lifting of the strand, and, on the other hand, the passage of a curved-up strand end through the shearing machine between the upper and the lower cutters is made possible in a simple way.

These objects are achieved according to the invention in that the upper cutter is adjustable, by means of an adjustment device, from a working position immediately above the surface of the piece to be cut, into a pulled-back position at a larger distance from the surface of the piece to be cut, and vice versa.

For precisely fixing the position of the upper cutter in the working position, a stopper for limiting the movement of the upper cutter is advantageously provided, which stopper is adjustably and fixably arranged on the carrying construction. By means of the stopper the upper cutter can always be brought, in a simple way, from the pulled-back position exactly into the working position, and furthermore, in continuous casting plants with which strands of various thicknesses can be cast, the position of the upper cutter can always be chosen closely above the upper strand surface in accordance with those different thicknesses. Thus, not only the upper cutter can be shifted from the pulled-back position into a certain working position, but also the working position can be changed independently therefrom.

According to a preferred embodiment, the upper cutter is linked to the carrying construction by means of a toggle linkage, wherein the toggle linkage is bowed when the upper cutter is in the pulled-back position, and, when the upper cutter is in the working position, it is bowed slightly beyond its fully stretched or straight up and down position so that its joint knee abuts with the stopper fastened to the carrying construction. Thereby, adjustment of the cutter is possible within a very short span of time, and no holding force for fixing the upper cutter need be applied by the adjustment device when the upper cutter is in the working position.

A preferred embodiment is characterised in that, for actuating the toggle linkage, one of the levers is designed as an angle lever which, with one end, is linked to part of the adjustment device that is designed as a pressure medium cylinder. Thereby, pressure-medium-energy-saving actuation of the toggle linkage is possible.

BRIEF DESCRIPTION OF THE DRAWINGS

The invention will now be described in more detail by way of one embodiment and with reference to the accompanying drawings presented in schematic illustration, wherein.

DESCRIPTION OF AN EXEMPLARY EMBODIMENT

Figure 1:
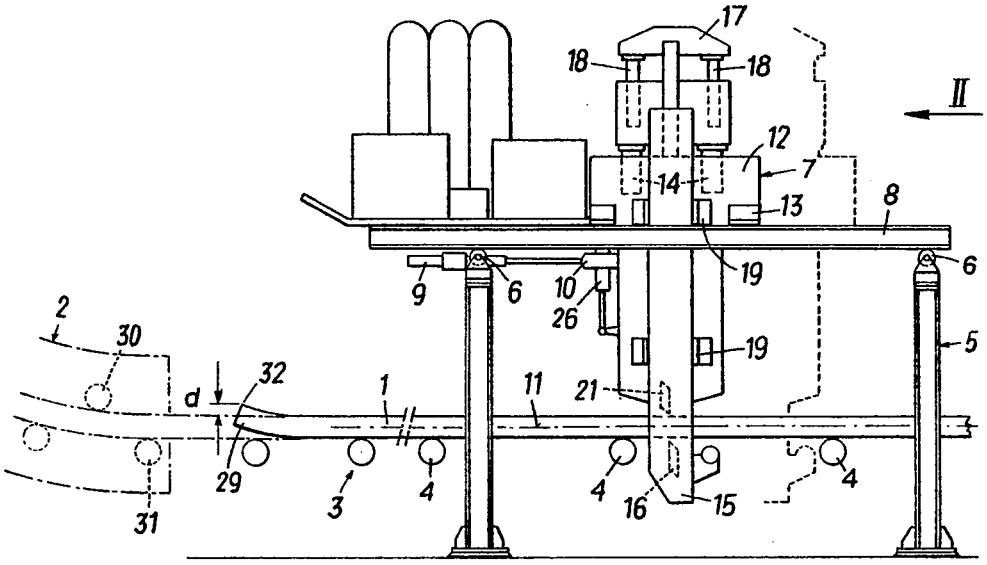
FIG. 1 is a side view of a shearing machine.
Figure 2:
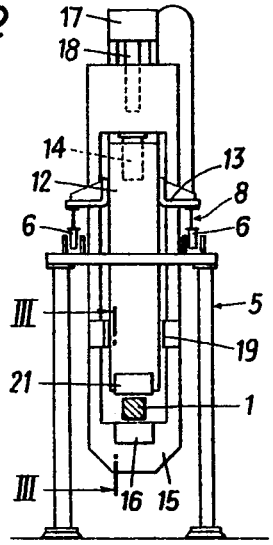
FIG. 2 is a front view thereof in the direction of the arrow II of FIG. 1.

A billet 1 is conveyed out of a straightening zone 2 and 1 is guided on to a run-out roller table 3 following the straightening zone 2. Rollers 4 of the run-out roller table are rotatably mounted in a supporting frame, which for reasons of clarity is not illustrated.

The run-out roller table 3 is bridged over by a machine frame, which in general is denoted by 5. On the upper side of the machine frame, running rollers 6 are rotatably mounted, on which the shearing machine 7 rests via a shearing frame 8 in which it is mounted.

In order to be able to carry out the cutting procedure during the conveyance of the billet, the shearing frame 8 is displaceable along the billet axis 11, up to the position illustrated in FIG. 1 by dashed lines, by a pressure medium cylinder 9 whose piston engages at the shearing machine by means of a coupling 10.

The shearing machine itself comprises a carrying construction 12, which is rigidly fastened to the shearing frame 8 by means of brackets 13. A lower-cutter carrier 15 is mounted opposite this carrying construction and is adjustable in height; it can be lifted by means of the two pressure medium cylinders 14. The lower cutter 16 is mounted in the lower-cutter carrier 15 such that its cutting edge, if the lower cutter carrier 15 is in a lowered position (as is illustrated in FIG. 1), comes to lie near the lower side of the billet resting on the rollers of the run-out roller table. A transverse beam 17 is rigidly connected with the carrying construction and coupled with the lower-cutter carrier 15 via pressure medium cylinders 18. These presure medium cylinders 18 serve for controlled lowering of the lower-cutter carrier. Guides 19, which are mounted at the carrying construction, serve for slide-mounting of the lower-cutter carrier at the carrying construction 12.

Figure 3:
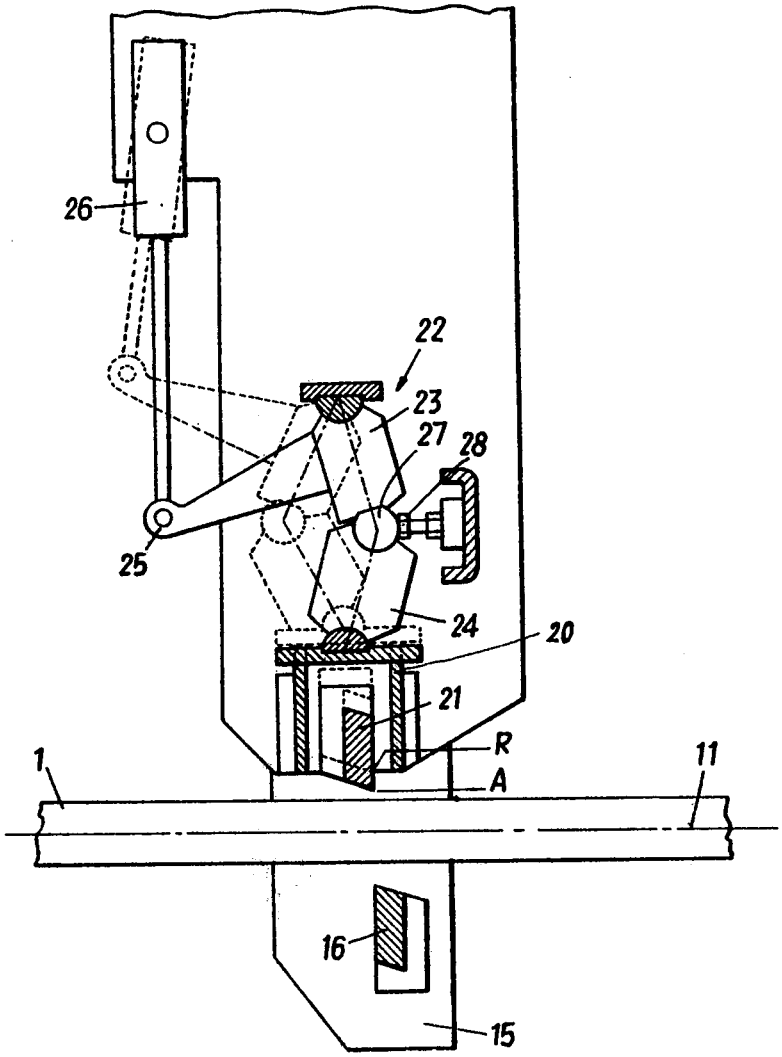
FIG. 3 illustrates a detail of a shearing machine, sectioned along line III—III of FIG. 2.

The upper cutter 21 mounted in an upper-cutter head 20 is fastened to the carrying construction by means of a toggle linkage 22, which is formed of an angle lever 23 and a single-armed lever 24 (FIG. 3). The end 25 of the angle lever is linked to a piston rod of a pressure medium cylinder 26. By actuating this pressure medium cylinder 26, the toggle linkage can be moved from the position illustrated in FIG. 3 in full lines, into the position illustrated in this Figure in dashed lines, and vice versa. As a result the upper cutter is movable from a lowered position—the working position A—into a lifted position—the pulled-back position R—, and vice versa. In the lowered position, i.e. in the working position of the upper cutter 21, the toggle linkage has been moved slightly beyond its straight up and down or fully stretched position and its knee 27 abuts a stopper 28 which is fastened to the carrying construction. This stopper is adjustable relative to the carrying construction by means of a thread and is fixable thereto by means of a counter nut. Due to the adjustability of the stopper 28, it is possible to change the working position A of the upper cutter relative to the carrying construction independently of the movability of the upper cutter from the working position A into the pulled-back position R, and vice vera.

The shearing machine according to the invention functions in the following way: As soon as the billet 1, with its end 29, has left the last two rollers 30, 31 of the straightening aggregate, as seen in the conveying direction, the end of the billet assumes the bent-up position illustrated in FIG. 1. This curved up end is brought about as a result of the distance between the positions of the last two rollers 30 and 31 arranged within the straightening aggregate, as well as due to the resilience of the strand end which has already totally solidified. The upper edge 32 of the end 29 is above the billet upper side of the plain billet by a distance "d". During the passage of the end section 29 of the billet 1 through the shearing machine, the upper cutter must be lifted by this distance "d". This is effected by retraction of the piston rod of pressure medium cylinder 26, whereby the toggle linkage 22 is moved beyond its fully stretched position into the position illustrated in FIG. 3 in dashed lines. The upper cutter is brought into this position immediately after cutting, which motion preceeds the conveyance of the end 29 through the shearing machine. This also occurs before the shearing machine is moved back from the position illustrated in FIG. 1 in dashed lines into the position illustrated in full lines by means of the pressure medium cylinder 9, and the billet again enters between the two cutters.

The invention is not limited to the embodiment of the description of the figures, but can be modified in various aspects. Thus, for instance, instead of the toggle linkage, any other adjustment means, e.g. a screw rod, can be provided.

What we claim is:

1. In a shearing machine to be used in bow-type continuous casting plants for separating continuously cast strands, such as slabs and billets, said continuously cast strands constituting pieces to be cut, of the type including a carrying construction, two cutters being arranged in said carrying construction, one of said two cutters being an upper cutter and the other of said two cutters being a lower cutter, said lower cutter being movable towards and away from said upper cutter and said upper cutter being fixed to said carrying construction during the cutting procedure, the improvement comprising position adjustment means for shifting said upper cutter out of a working position immediately above the surface of said pieces to be cut, into a pulled-back position farther removed from the surface of said pieces to be cut, and vice versa, said adjustment means comprising a toggle linkage for linking said upper cutter to said carrying construction, said toggle linkage being bowed in one direction when said upper cutter is in the pulled-back position, and bowed slightly beyond its fully stretched position in the other direction when the upper cutter is in the working position, and a stopper for limiting the movement of the upper cutter, said stopper being arranged on the carrying construction, a knee of said toggle linkage abutting said stopper when the upper cutter is in the working position so as to hold said upper cutter in place during a cutting operation without the application of an external holding force.

2. A shearing machine as set forth in claim 1, wherein said stopper adjusts the position of said upper cutter when in the working position, said stopper being adjustably and fixably arranged on said carrying construction so that its point of abutment with the toggle linkage can be changed.

3. A shearing machine as set forth in claim 1 wherein said toggle linkage includes two levers, one of said levers being designed as an angle lever, and wherein said adjustment means further includes a pressure medium cylinder, one end of said angle lever being linked to said pressure medium cylinder.

* * * * *